US008919924B2

(12) United States Patent
Lee et al.

(10) Patent No.: US 8,919,924 B2
(45) Date of Patent: Dec. 30, 2014

(54) INKJET PRINT HEAD AND METHOD OF MANUFACTURING THE SAME

(75) Inventors: Tae Kyung Lee, Gyunggi-do (KR); Jae Chang Lee, Gyunggi-do (KR); Hwa Sun Lee, Gyunggi-do (KR)

(73) Assignee: Samsung Electro-Mechanics Co., Ltd., Suwon (KR)

( * ) Notice: Subject to any disclaimer, the term of this patent is extended or adjusted under 35 U.S.C. 154(b) by 444 days.

(21) Appl. No.: 12/929,612

(22) Filed: Feb. 3, 2011

(65) Prior Publication Data

US 2011/0273514 A1 Nov. 10, 2011

(30) Foreign Application Priority Data

May 10, 2010 (KR) ..... 10-2010-0043651
Jun. 17, 2010 (KR) ..... 10-2010-0057556

(51) Int. Cl.
*B41J 2/135* (2006.01)
*B41J 2/14* (2006.01)
*B41J 2/16* (2006.01)

(52) U.S. Cl.
CPC .... *B41J 2/14* (2013.01); *B41J 2/16* (2013.01); *B41J 2/1632* (2013.01)
USPC ..... 347/44; 347/33

(58) Field of Classification Search
USPC ..... 347/44, 33
See application file for complete search history.

(56) References Cited

U.S. PATENT DOCUMENTS 6,029,349 A * 2/2000 Berkhout et al. ..... 29/890.1
2002/0075361 A1 6/2002 Kanda et al.
2003/0177639 A1* 9/2003 Berg ..... 29/847
2006/0181580 A1* 8/2006 Lee et al. ..... 347/68
2009/0102895 A1 4/2009 Kim et al.
2009/0225132 A1* 9/2009 Ikeda ..... 347/47
2010/0319195 A1 12/2010 Kim et al.

FOREIGN PATENT DOCUMENTS

| | | | | |
|---|---|---|---|---|
| CN | 1359799 A | | 7/2002 | |
| EP | 0830946 A1 | | 3/1998 | |
| JP | 3-164256 | | 7/1991 | |
| JP | 5-177837 | | 7/1993 | |
| JP | 10-157149 | | 6/1998 | |
| JP | 11-170549 | | 6/1999 | |
| JP | 11-170549 A | * | 6/1999 | ..... B41J 2/16 |
| KR | 10-2008-0098158 | | 11/2008 | |
| KR | 10-2009-0040157 | | 4/2009 | |

OTHER PUBLICATIONS

Japanese Office Action dated Mar. 21, 2012 issued in corresponding Japanese Patent Application No. 2011-024730
Korean Office Action mailed Jan. 19, 2012 issued in corresponding Korean Patent Application No. 10-2010-0043651.
Korean Office Action issued Feb. 21, 2012 in corresponding Korean Patent Application No. 10-2010-0057556.
Chinese Office Action issued Aug. 21, 2013 in corresponding Chinese Application No. 201110053408.1.

* cited by examiner

*Primary Examiner* — Manish S Shah
*Assistant Examiner* — Yaovi Ameh

(57) ABSTRACT

Disclosed are an inkjet print head and a method of manufacturing the same. An inkjet print head according to an aspect of the invention may include: an inkjet board having an ink passage therein; a cutting portion provided outside the ink passage of the inkjet board and having a cutting surface created by separation into head chip units of the inkjet board; and an auxiliary cutting portion provided from one surface of the cutting portion inwardly in a thickness direction of the inkjet board, and assisting the separation into head chip units of the inkjet board.

18 Claims, 15 Drawing Sheets

INKJET PRINT HEAD AND METHOD OF MANUFACTURING THE SAME

CROSS-REFERENCE TO RELATED APPLICATIONS

This application claims the priority of Korean Patent Application Nos. 10-2010-0043651 filed on May 10, 2010, and 10-2010-0057556 filed on Jun. 17, 2010, in the Korean Intellectual Property Office, the disclosure of which is incorporated herein by reference.

BACKGROUND OF THE INVENTION

1. Field of the Invention

The present invention relates to an inkjet print head and a method of manufacturing the same, and more particularly, to an inkjet print head and a method of manufacturing the same that can prevent the ingress of foreign bodies, generated when nozzles are opened and inkjet print heads are cut into chip units, into the nozzles when side shooting type inkjet print heads are manufactured.

2. Description of the Related Art

In general, an inkjet print head is a structure that converts an electrical signal into a physical force so that ink is ejected in droplets through small nozzles. Inkjet print heads are divided into side shooting type inkjet print heads and roof shooting type inkjet print heads according to the direction in which pressure is exerted upon ink and the direction in which ink droplets are ejected.

As for a side shooting type inkjet print head, the direction in which pressure is exerted upon ink is perpendicular to the direction in which ink droplets are ejected. As for a roof shooting type inkjet print head, a direction in which pressure is exerted on ink is the same as a direction in which ink droplets are ejected.

As for the above-described side shooting type inkjet print head, various types of inkjet print heads can be manufactured in large quantities by increasing the integration of heads on a silicon wafer. However, since nozzles are formed by using a dicing process such as blade dicing, laser dicing or laser cutting, the ingress of foreign bodies, such as silicon particles produced during dicing, into the nozzles may occur.

Besides, blades may cause physical damage to the nozzles.

As such, if nozzles are blocked due to the ingress of foreign bodies or the shape of the nozzles undergoes physical damage, a directional failure or wetting may be caused when an inkjet print head ejects ink, thereby deteriorating the performance of inkjet print heads.

SUMMARY OF THE INVENTION

An aspect of the present invention provides an inkjet print head and a method of manufacturing the same that prevents the ingress of foreign bodies, generated when nozzles are opened and side surfaces in a width direction of inkjet print heads, into nozzles when side shooting type inkjet print heads are manufactured.

An aspect of the present invention also provides an inkjet print head and a method of manufacturing the same that facilitate the cutting of inkjet print heads into chip units.

According to an aspect of the present invention, there is provided an inkjet print head including: an inkjet board having an ink passage therein; and a cutting portion provided outside the ink passage in cross section in a longitudinal direction of the inkjet board, having a cutting surface created by separation into head chip units of the inkjet board, and having a cutting mark comprising a cut trace provided on the cutting surface.

The cutting mark may have surface roughness higher than another portion in cross section in the longitudinal direction.

The cutting surface may include a portion provided outside the cutting mark and having surface roughness smaller than the cutting mark.

A portion having relatively small surface roughness may be provided within the cutting mark.

The inkjet print head may further include an auxiliary cutting portion provided from one surface of the cutting portion inwardly in a thickness direction of the inkjet board, and assisting the separation into head chip units of the inkjet board.

According to an aspect of the present invention, there is provided an inkjet print head including: an inkjet board having an ink passage therein; a cutting portion provided outside the ink passage of the inkjet board and having a cutting surface created by separation into head chip units of the inkjet board; and an auxiliary cutting portion provided from one surface of the cutting portion inwardly in a thickness direction of the inkjet board, and assisting the separation into head chip units of the inkjet board.

The auxiliary cutting portion may include at least one through hole formed through the inkjet board.

The auxiliary cutting portion may include at least one recess provided from the one surface of the cutting portion inwardly in the thickness direction of the inkjet board.

According to another aspect of the present invention, there is provided a method of manufacturing an inkjet print head, the method including: forming a plurality of ink passages in an upper board and a lower board in order to form a wafer having a plurality of inkjet print heads continuously arrayed thereon; etching end portions of the plurality of ink passages in a longitudinal direction of the inkjet print heads in order to expose nozzles being the end portions of the ink passages while forming connection portions outside the ink passages; forming the wafer by bonding the upper board and the lower board to each other; cutting the wafer in order to expose side surfaces in the longitudinal direction of the inkjet print heads; and cutting the connecting portions.

The method may further include partially etching the connecting portions in order to facilitate the cutting of the connecting portions to thereby form through holes formed through the inkjet print heads.

The method may further include partially etching the connecting portions in order to facilitate the cutting of the connecting portions to thereby form recesses provided inwardly in a thickness direction of the inkjet print heads.

The forming of the wafer may be performed by silicon direct bonding (SDB) of the upper board and the lower board.

Above operations may be performed in a sequential manner.

The cutting of the wafer may be performed by using a dicing process.

The cutting of the connecting portions may include forming cutting marks comprising cut traces on cutting surfaces of the connecting portions.

The cutting of the connecting portions may be performed so that surface roughness of cutting marks to be formed on cutting surfaces of the connecting portions is higher than that of another portion in cross section in the longitudinal direction of the inkjet print heads.

BRIEF DESCRIPTION OF THE DRAWINGS

The above and other aspects, features and other advantages of the present invention will be more clearly understood from the following detailed description taken in conjunction with the accompanying drawings, in which.

DETAILED DESCRIPTION OF THE PREFERRED EMBODIMENT

Figure 1:
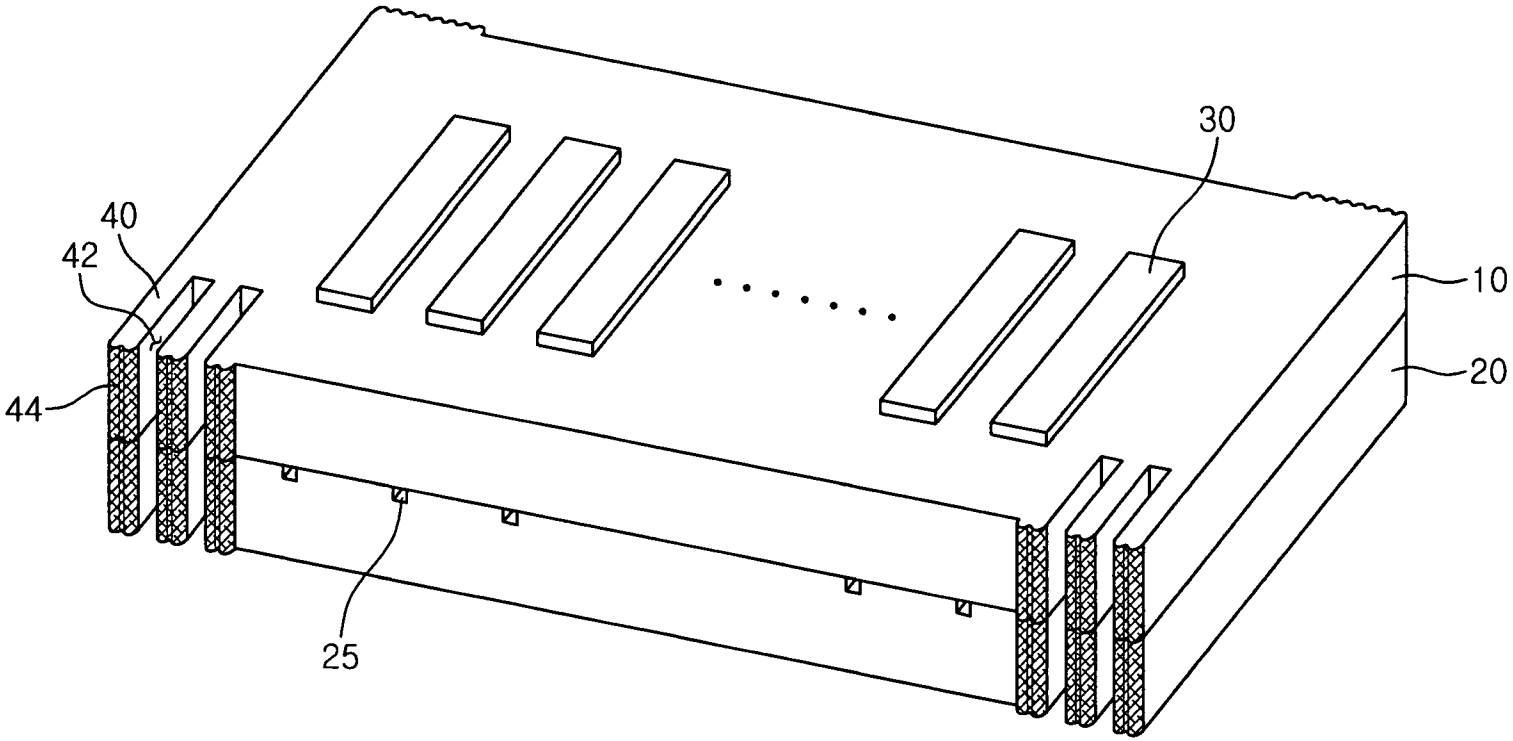
FIG. 1 is a perspective view illustrating an inkjet print head according to an exemplary embodiment of the present invention.

Exemplary embodiments of the present invention will now be described in detail with reference to the accompanying drawings. The invention may, however, be embodied in many different forms and should not be construed as being limited to the embodiments set forth herein. Rather, these embodiments are provided so that this disclosure will be thorough and complete, and will fully convey the scope of the invention to those skilled in the art.

In the drawings, the shapes and dimensions may be exaggerated for clarity, and the same reference numerals will be used throughout to designate the same or like components.

FIG. 1 is a perspective view illustrating an inkjet print head according to an exemplary embodiment of the invention. Referring to FIG. 1, an inkjet print head according to this embodiment includes an upper board 10 and a lower board 20, in which ink passages are formed, and piezoelectric actuators 30 formed on an upper surface of the upper board 10.

A plurality of pressure chambers (not shown) are formed in the upper board 10. The lower board 20 may include an ink inlet (not shown) through which ink is introduced, manifolds (not shown) that transfer the ink, being introduced through the ink inlet, to the plurality of pressure chambers, and a plurality of nozzles 25 through which the ink is ejected. A plurality of restrictors (not shown) may be formed between the manifolds and the pressure chambers in order to prevent the ink inside the pressure chambers from flowing backward into the manifolds when the ink is being ejected.

Here, the upper board 10 may be a single crystal silicon board or an SOI board, and the lower board 20 may also be a single crystal silicon board or an SOI board. However, the present invention is not limited thereto. The ink passages may be formed by using a larger number of boards. Alternatively, the ink passages may be formed by using a single board. Here, components used to form the ink passages are merely exemplified. Ink passages having various types of configurations may be prepared according to requirements or design specifications The piezoelectric actuators 30 are formed on the upper surface of the upper board 10 at positions corresponding to the pressure chambers of the upper board 10. Further, the piezoelectric actuators 30 provide a driving force to eject the ink, being introduced into the pressure chambers, through the nozzles 25. For example, the piezoelectric actuators 30 may include a lower electrode serving as a common electrode, a piezoelectric film being transformed according to whether voltage is applied or not, and an upper electrode serving as a driving electrode.

The lower electrode may be formed over the entire surface of the upper board 10 and be formed of a single conductive metallic material. However, the lower electrode may be formed of two metallic thin layers formed of titanium (Ti) and platinum (Pt). The lower electrode serves as a diffusion prevention layer between the piezoelectric film and the upper board 10 as well as the common electrode. The piezoelectric film is formed on the lower electrode and is located on respective upper portions of the plurality of pressure chambers. The piezoelectric film may be formed of a piezoelectric material, and preferably, of a lead zirconate titanate (PZT) ceramic material. The upper electrode is formed on the piezoelectric film and may be formed of any one of Pt, Au, Ag, Ni, Ti and Cu.

In this embodiment, ink is ejected by using a piezoelectric driving method using the piezoelectric actuators 30. However, the present invention is not limited to the ink ejection method. Ink ejection can be performed by using various kinds of methods including a thermal driving method according to conditions being required.

The inkjet print head according to this embodiment includes cutting portions 40 that are formed outside the ink passages and have cutting surfaces created by separation into head chip units of inkjet print heads. That is, the cutting portions 40 may be formed at both sides in a longitudinal direction of the inkjet print head and may include auxiliary cutting portions 42 that are each formed from one surface of the cutting portions 40 inwardly in a thickness direction of the inkjet print head and assist the separation into head chip unit.

Meanwhile, terms regarding directions will now be defined. As shown in FIG. 1, the longitudinal direction refers to a direction running from one of the plurality of piezoelectric actuators 30 to another piezoelectric actuator 30, the thickness direction refers to a direction running from the upper board 10 to the lower board 20, or vice versa, and a width direction refers to a direction in which ink is ejected from the pressure chambers to the nozzles 25, or vice versa.

In this embodiment, the auxiliary cutting portion 42 is at least one through hole that is formed through the inkjet print head from one surface of the cutting portion 40. However, this is only an example. The auxiliary cutting portion 42 may be a recess provided inwardly in the thickness direction of the inkjet print head. Other than that, any configuration that facilitates the operation of cutting one inkjet print head from another may be included.

Furthermore, in this embodiment, the auxiliary cutting portions 42 are formed at the nozzles, which are located at positions corresponding to one side of the width direction of the inkjet print head. However, the present invention is not limited thereto. Auxiliary cutting portions having various kinds of configurations may be formed at the other side of the width direction of the inkjet print head.

Cut traces 44, which may occur when one inkjet print head is mechanically cut away from another on a wafer, may be formed on the cutting surfaces of the cutting portions 40, which are side surfaces in the width direction of the inkjet print head. That is, the creation of smooth cutting surfaces between one inkjet print head and another inkjet print head adjacent thereto is desirable. However, the cut traces 44 may be generated due to mechanical cutting, and thus the cutting surface may be rough.

Also, in this embodiment, a description is made of a case in which the cut traces 44 are formed on the cutting surfaces, located at the nozzles, on the side surfaces of the width direction of the inkjet print head. However, the cut traces may also be formed on the cutting surfaces of the side surfaces that face the cutting surfaces, located at the nozzles, on the side surfaces of the width direction of the inkjet print head.

Hereafter, an inkjet print head according to this embodiment that has the above-described configuration will be described.

First, a manufacturing method according to a preferred embodiment of the invention will be described in brief. Ink passages are formed such that a plurality of inkjet print heads are arrayed on an upper board and a lower board. The upper board and the lower board are bonded to each other. The plurality of inkjet print heads are cut into chip units to thereby manufacture inkjet print heads according to an exemplary embodiment of the invention. Meanwhile, the processes of forming the ink passages in the upper board and the lower board may be performed regardless of order. That is, the ink passages may be formed in the upper board first and then the lower board, or vice versa. Alternatively, the ink passages may be formed in the upper board and the lower board at the same time. However, for the convenience of explanation, the process of forming the ink passages in the upper board first will be described.

Furthermore, the processes of forming the ink passages are generally performed by using at least one board. Hereinafter, for the convenience of explanation, a detailed description of the processes of forming the ink passages will be omitted.

Figure 4:
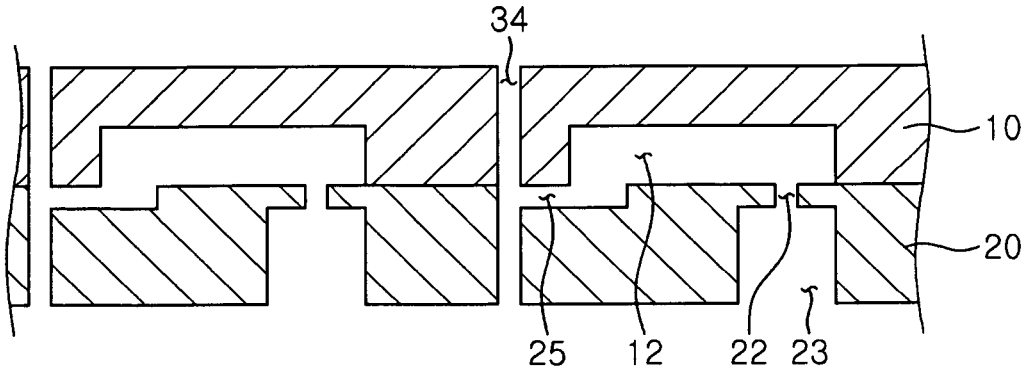
FIG. 4 is a cross-sectional view illustrating an operation of bonding the upper board and the lower board to each other in a method of manufacturing a wafer unit of the inkjet print head according to the exemplary embodiment as shown in FIG. 1.
Figure 5:
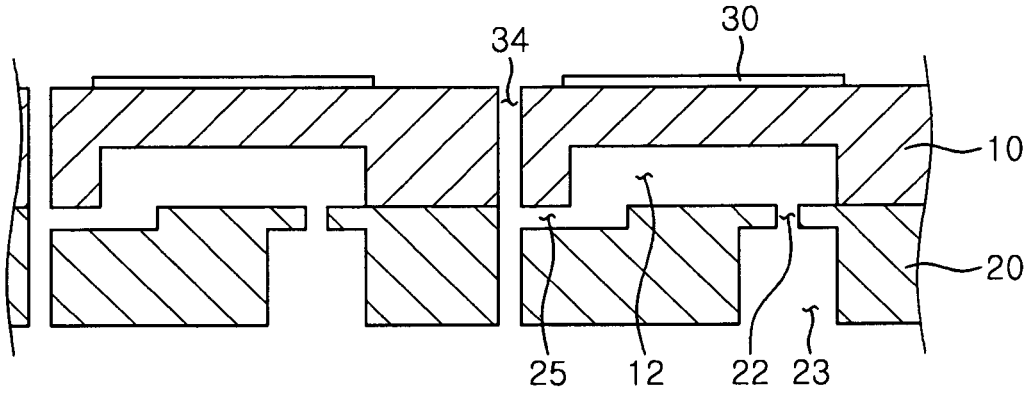
FIG. 5 is a cross-sectional view illustrating an operation of forming piezoelectric actuators on an upper part of the upper and lower boards bonded to each other in a method of manufacturing a wafer unit of the inkjet print head according to the exemplary embodiment as shown in FIG. 1.

FIGS. 2A through 2D are views illustrating a process of forming ink passages in an upper board in a method of manufacturing a wafer unit of the inkjet print head according to the embodiment, as shown in FIG. 1. FIGS. 3A through 3E are views illustrating a process of forming ink passages in a lower board. FIG. 4 is a view illustrating a process of bonding the upper board and the lower board to each other. FIG. 5 is a cross-sectional view illustrating a process of forming piezoelectric actuators on an upper part of the upper board.

Figure 6:
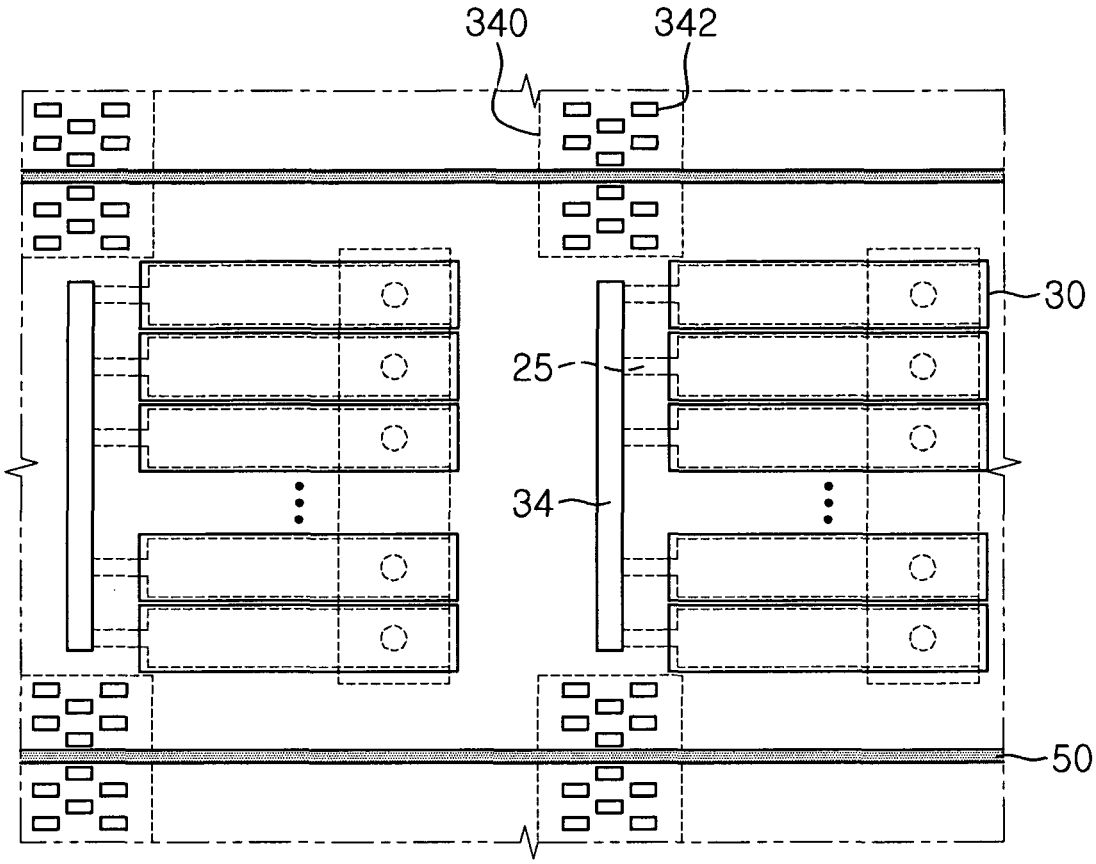
FIG. 6 is a plan view illustrating an operation of cutting side surfaces in a longitudinal direction in a method of manufacturing a wafer unit of the inkjet print head according to the exemplary embodiment as shown in FIG. 1.

FIG. 6 is a plan view illustrating a process of cutting side surfaces in a longitudinal direction.

As shown in 2A, the upper board 10, which is formed of a single crystal silicon board or an SOI wafer, is prepared. A desired ink passage may be precisely and readily formed into a fine size by using micromaching techniques including photolithography and etching.

In particular, an SOT wafer has an insulating layer formed between two silicon layers. Since the insulating layer serves as an etch stop layer, it is possible to accurately control the height of the pressure chambers.

The upper board 10 has a thickness of approximately 50 μm to 200 μm, which is appropriately determined according to the thickness of the pressure chambers 12. Here, the lower surface of the upper board 10 can be controlled to a desirable thickness by chemical mechanical polishing (CMP).

Then, as shown in 2B, a lower surface of the upper board 10 is etched to thereby form the plurality of pressure chambers 12. For explanation convenience, in FIGS. 2A through 2D, the ink passages are formed in the upper board 10 in association with two adjacent inkjet print heads. Alternatively, the ink passages may be formed in the upper board 10 in association with a plurality of inkjet print heads.

Meanwhile, as a method of etching the lower surface of the upper board 10 to form the pressure chambers 12, a known etching method using photoresist as an etching mask may be used.

That is, the lower surface of the upper board 10 is coated with photoresist, which is then developed to thereby form openings used to form the pressure chambers 12. As the photoresist is used as an etching mask, portions, exposed through the openings, are removed by dry or wet etching, thereby forming the pressure chambers 12. This method may be used in an etching process in association with a lower board to be described below.

Figure 2A:
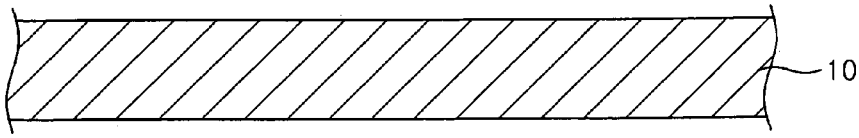
FIGS. 2A through 2D are views illustrating an operation of forming ink passages in an upper board in a method of manufacturing a wafer unit of the inkjet print head according to the exemplary embodiment as shown in FIG. 1.
Figure 2B:
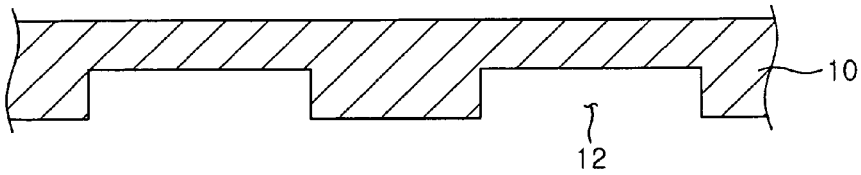
Figure 2C:
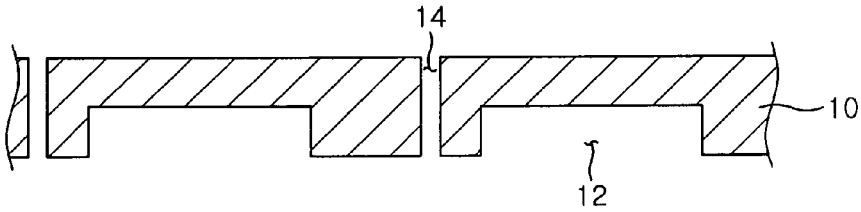
Figure 2D:
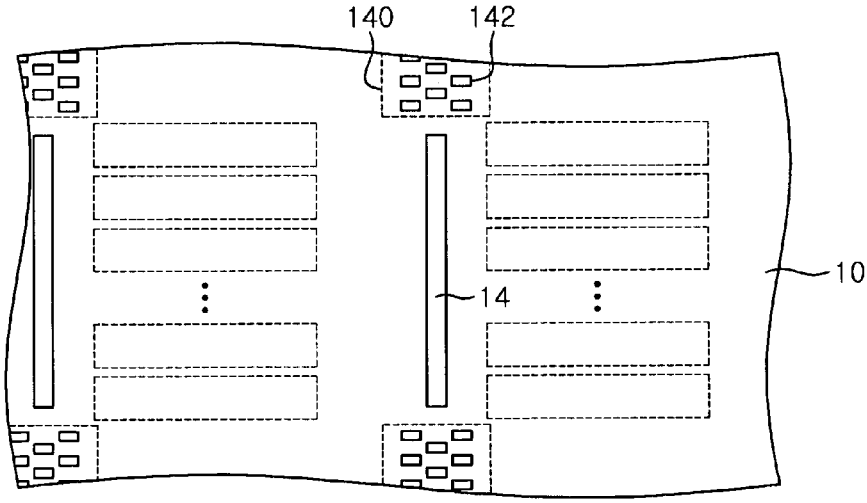
Figure 3A:
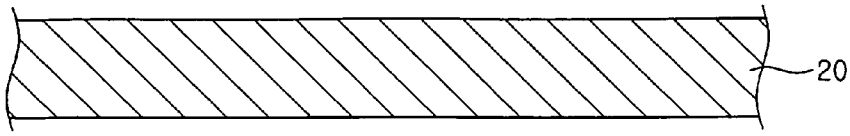
FIGS. 3A through 3E are views illustrating an operation of forming ink passages in a lower board in a method of manufacturing a wafer unit of the inkjet print head according to the exemplary embodiment as shown in FIG. 1.
Figure 3B:
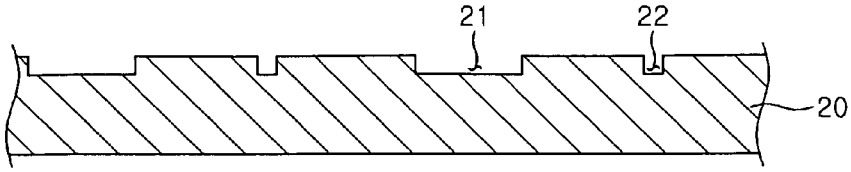
Figure 3C:
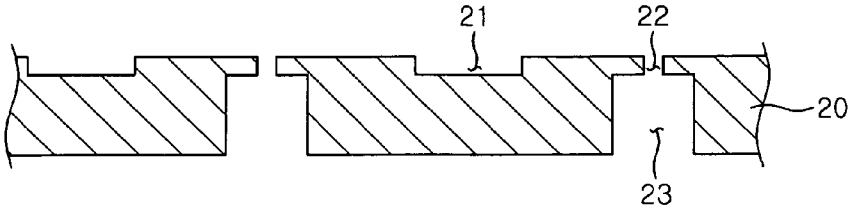
Figure 3D:
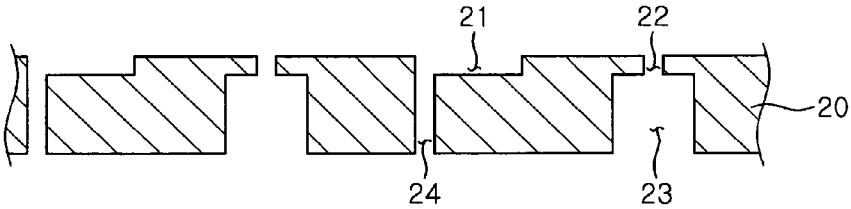
Figure 3E:
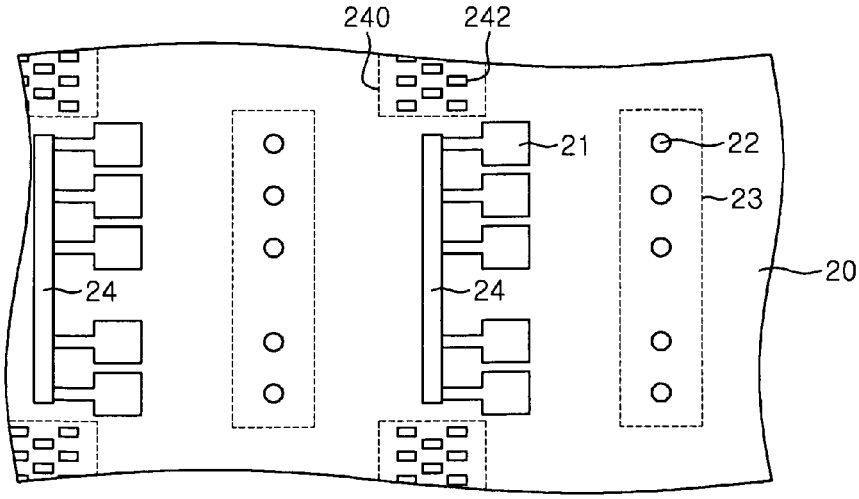

Then, as shown in FIG. 2C, in order to form nozzles of inkjet print heads adjacent to each other in the width direction, the upper board 10 is etched to thereby form upper openings 14.

As shown in 2D, the upper openings 14 are formed by etching the entire upper board 10 except for upper connecting portions 140 in the longitudinal direction of the inkjet print heads.

Here, the upper connecting portions 140 may be partially etched to thereby form upper auxiliary cutting portions 142.

The upper auxiliary cutting portions 142 may be through holes, formed through the upper board 10, or recesses provided from one surface of the upper board 10 inwardly in the thickness direction.

Subsequently, a process of forming ink passages in the lower board 20 will be described with reference to FIGS. 3A through 3E. As shown in 3A, the lower board 20, which is formed of a single crystal silicon board or an SOI wafer, is prepared.

In the case that an SOI wafer, which has two silicon layers with an insulating layer interposed therebetween, is used as the lower board 20, the insulating layer may serve as an etch stop layer, thereby accurately controlling the thicknesses of manifolds, restrictors, dampers and the like. The lower board 20 may have a thickness of approximately 50 μm to 200 μm. However, the present invention is not limited thereto, and the thickness of the lower board 20 may be determined according to a desired value.

As shown in 3B, an upper surface of the lower board 20 is etched to form restrictors 22 and passages 21 in which dampers (not shown) and nozzles 25 will be formed. Here, when the lower board 20 is formed of an SOI wafer, since the insulating layer thereof serves as an etch stop layer, it is possible to accurately control the thickness of the passages 21 in which the restrictors 22, the dampers (not shown) and the nozzles 25 will be formed. Furthermore, as describe above, the lower board 20 may be etched by using photoresist as an etching mask according to dry or wet etching.

As shown in 3C, a lower surface of the lower board 20 is etched to form an ink inlet (not shown) and manifolds 23. Ink, which is introduced through the ink inlet, is transferred from the manifolds 23 to the pressure chambers 12 via the restrictors 22.

As shown in 3D, in order to form nozzles of inkjet print heads adjacent to each other in the width direction, the lower board 20 is completely etched to thereby form lower openings 24. As shown in 3E, the lower openings 24 are formed by etching the entire lower board 20 except for lower connecting portions 240 in the longitudinal direction of the inkjet print heads. Since the nozzles 25 are opened by etching, the shape of the nozzles 25 is not physically damaged. Furthermore, it is possible to prevent the ingress of foreign bodies, generated when the nozzles 25 are opened, into the nozzles 25.

Here, the lower connecting portions 240 may be partially etched to form lower auxiliary cutting portions 242. The lower auxiliary cutting portions 242 may be through holes, formed through the lower board 20, or recesses provided from one surface of the lower board 20 inwardly in the thickness direction.

Subsequently, as shown in FIG. 4, the upper board 10 and the lower board 20 are bonded to each other to thereby form a wafer having a plurality of inkjet print heads arrayed thereon. The upper board 10 and the lower board 20 may be bonded to each other by silicon direct bonding (SDB). That is, while the upper board 10 and the lower board 20 are sufficiently close to each other, the upper and lower boards 10 and 20 are directly bonded to each other by annealing without using an adhesive.

In this embodiment, after the upper openings 14 and the lower openings 24 are formed in the upper board 10 and the lower board 20, respectively, to thereby open the nozzles 25, the upper board 10 and the lower board 20 are then bonded to each other. However, the present invention does not limit the order of performing these operations. Alternatively, after the upper board 10 and the lower board 20 are bonded to each other, the upper and lower boards 10 and 20 may then be etched to thereby open the nozzles 25. When the upper board 10 and the lower board 20 being bonded to each other are etched in order to open the nozzles 25, the upper connecting portions 140 and the lower connecting portions 240 may be partially etched to thereby form the upper and lower auxiliary cutting portions 142 and 242, respectively.

Then, as shown in FIG. 5, the piezoelectric actuators 30 are formed on the upper surface of the upper board 10 at positions corresponding to the pressure chambers 12. The piezoelectric actuators 30 may be formed by using a method using a thick film process, such as screen printing, or a method of stacking bulk ceramic materials in head chip units.

As shown in FIG. 6, as for the plurality of inkjet print heads being arrayed in columns and rows on the wafer, side surfaces in the longitudinal direction of a plurality of inkjet print heads, arrayed in one row, are cut to separate the plurality of inkjet print heads in rows. Here, the side surfaces of the inkjet print heads may be cut by dicing such as blade dicing, laser dicing or laser cutting.

Here, in order to reliably prevent the ingress of foreign bodies, generated by a dicing process through the nozzles 25 opened by etching, the upper and lower surfaces of the wafer may be coated with protective films, such as UV films or dicing films, before dicing, thereby achieving passivation.

When the side surfaces in the longitudinal direction of the inkjet print heads are exposed by dicing, in this embodiment, since connecting portions 340 are formed on both sides in the longitudinal direction of the inkjet print heads, the ingress of foreign bodies, generated during dicing, into the nozzles 25 can be prevented.

Subsequently, the inkjet print heads are separated into chip units by cutting the connecting portions 340, shown in FIG. 6, thereby completing the inkjet print head, as shown in FIG. 1. When passivation is performed before dicing, separation into chip units needs to be carried out after the protective films are removed. The connecting portions 340 may be cut by mechanical processing, and cutting surfaces may be formed in the middle of the connecting portions 340.

Figure 7:
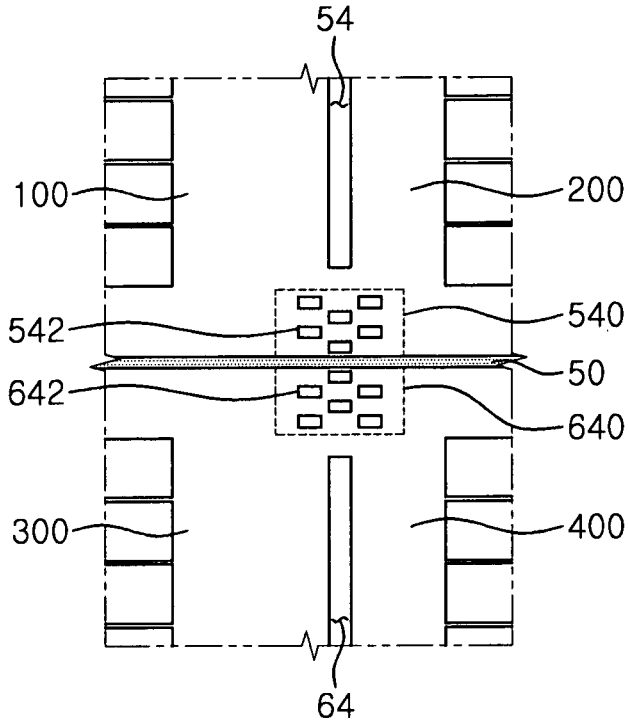
FIG. 7 is a partial plan view illustrating the configuration of connection portions of the inkjet print head according to the exemplary embodiment as shown in FIG. 1.

FIG. 7 is a partial plan view illustrating the configuration of connection portions of the inkjet print head according to the exemplary embodiment, shown in FIG. 1. FIG. 7 illustrates connecting portions of four adjacent inkjet print heads. A dicing line 50 is formed between a first connecting portion 540 and a second connecting portion 640. A first etching line 54 is formed between the first and second inkjet print heads 100 and 200 that share the first connecting portion 540. In the first etching line 54, nozzles are opened in any one of the first and second inkjet print heads 100 and 200.

A second etching line 64 is formed between third and fourth inkjet print heads 300 and 400 that share the second connecting portion 640. In the second etching line 64, nozzles are opened in any one of the third and fourth inkjet print heads 300 and 400.

At least one first auxiliary cutting portion 542 is formed in the first connecting portion 540 at positions corresponding to the first inkjet print head 100, the second inkjet print head 200, and the first etching line 54. The first auxiliary cutting portion 542 is a through hole formed through the wafer. Alternatively, the first auxiliary cutting portion 542 may be a recess provided from one surface of the wafer inwardly in the thickness direction.

In the same manner, at least one second auxiliary cutting portion 642 is formed in the second connecting portion 640 at positions corresponding to the third inkjet print head 300, the fourth inkjet print head 400, and the second etching line 64.

In this embodiment, since the first and second auxiliary cutting portions 542 and 642, each of which is formed of at least one through hole, are formed, the first and second inkjet print heads and the third and fourth inkjet print heads can be easily cut away from each other, thereby forming cutting surfaces which are as smooth as possible.

The method of manufacturing the inkjet print head according to the embodiment, as shown in FIG. 1, has been described. According to the method of manufacturing the inkjet print head according to the embodiment, as shown in FIG. 1, the ink passages are formed in the upper board 1; the upper board 10 is etched to form the upper openings 14; the ink passages are formed in the lower board 20; the lower board 20 is etched to form the lower opening 24; the upper board 10 and the lower board 20 are bonded to each other; the piezoelectric actuators 30 are formed on the upper surface of the upper board 10; the wafer is diced; and the wafer is cut into chip units. For the convenience of explanation, these operations are performed in a sequential manner. However, the present invention is not limited thereto. These operations may be performed in various orders according to the requirements of the respective processes. For example, the operations of etching the upper board and the lower board to form respective upper and lower openings may be performed at the same time as the operation of forming the ink passages or after the operation of bonding the upper board and the lower board to each other.

Figure 8:
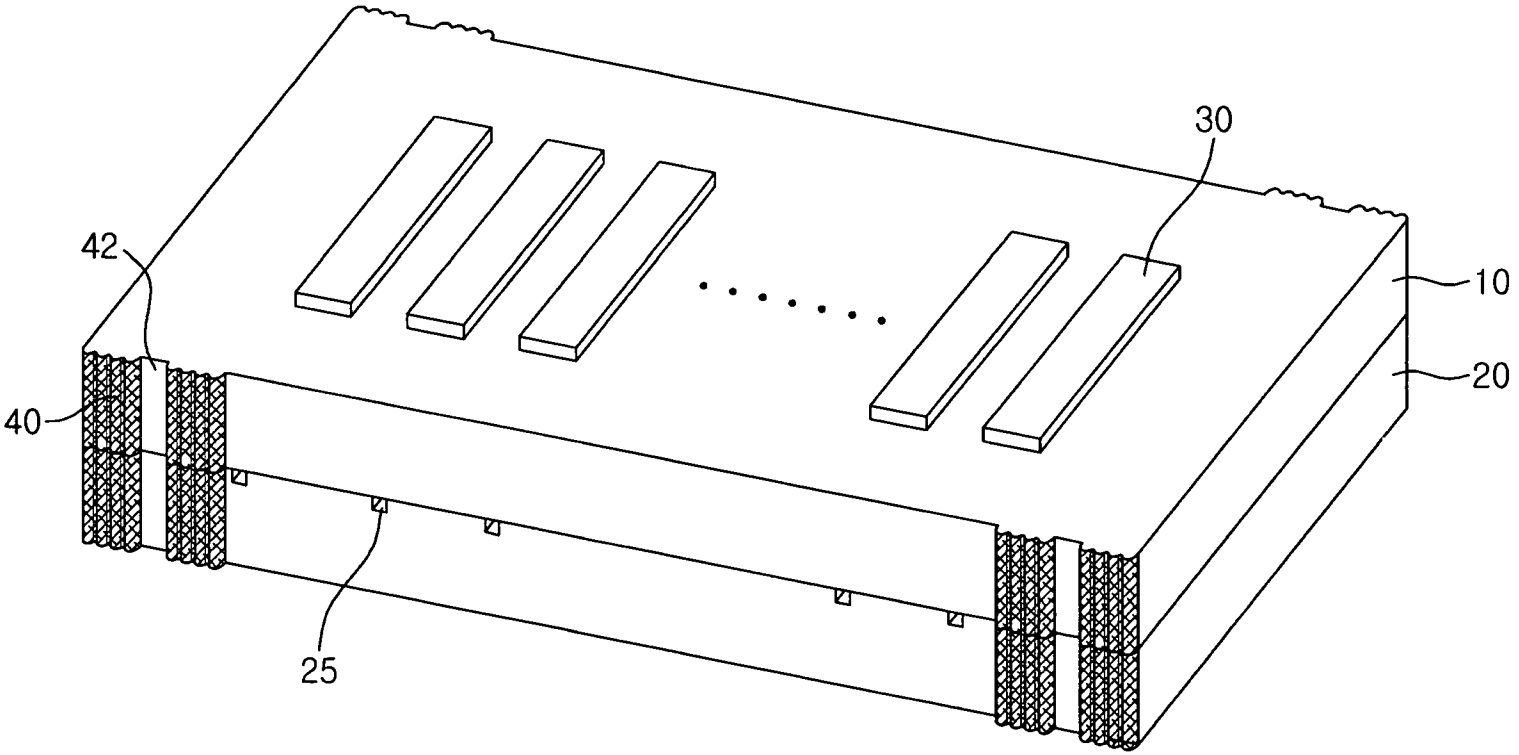
FIG. 8 is a perspective view illustrating an inkjet print head according to another exemplary embodiment of the present invention.
Figure 9:
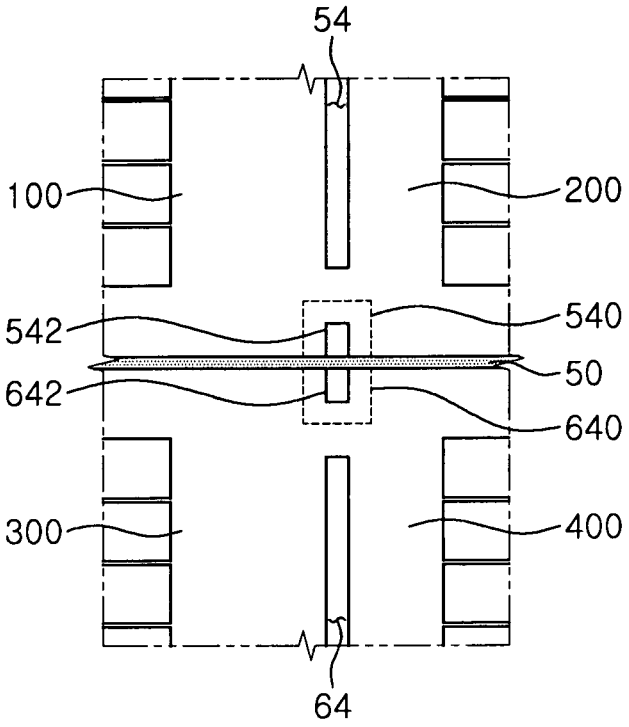
FIG. 9 is a partial plan view illustrating the configuration of connection portions of the inkjet print head according to the exemplary embodiment as shown in FIG. 8.

FIG. 8 is a perspective view illustrating an inkjet print head according to another exemplary embodiment of the invention. FIG. 9 is a partial plan view illustrating the configuration of connecting portions of inkjet print heads according to another exemplary embodiment of the invention.

The inkjet print head according to the exemplary embodiment of the invention, as shown in FIGS. 8 and 9, is different from the inkjet print head according to the exemplary embodiment, as shown in FIG. 1, in that auxiliary cutting portions are formed outside cutting portions having cutting marks such as cut traces. Therefore, for the convenience of explanation, the above-described differences in configuration will be described.

As shown in FIG. 8, the inkjet print head according to this embodiment has the auxiliary cutting portions 42 that are formed outside the ink passages in cross section in the longitudinal direction and formed outside the cutting portions 40 having cutting marks such as cut traces. The auxiliary cutting portions 42 include portions having surface roughness lower than the cutting portions 40 having the cutting marks formed thereon.

When upper and lower boards are completely etched in order to form nozzles of inkjet print heads adjacent to each other in the width direction, the upper and lower boards may be etched to thereby form the auxiliary cutting portions 42.

As shown in FIG. 9, the first connecting portion 540 is formed between the first and second inkjet print heads 100 and 200, and the second connecting portion 640 is formed between the third and fourth inkjet print heads 300 and 400. The dicing line 50 is formed between the first connecting portion 540 and the second connecting portion 640. The first etching line 54 is formed between the first and second inkjet print heads 100 and 200, and the second etching line 64 is formed between the third and fourth inkjet print heads 300 and 400.

The first auxiliary cutting portion 542 is formed in the first connecting portion 540 at a position corresponding to the first etching line 54. The second auxiliary cutting portion 642 is formed in the second connecting portion 640 at a position corresponding to the second etching line 64. Here, the auxiliary cutting portion 542 is a hole formed through the wafer. However, the present invention is not limited thereto. The auxiliary cutting portion 542 may be a recess provided from one surface of the wafer inwardly in the thickness direction.

Figure 10:
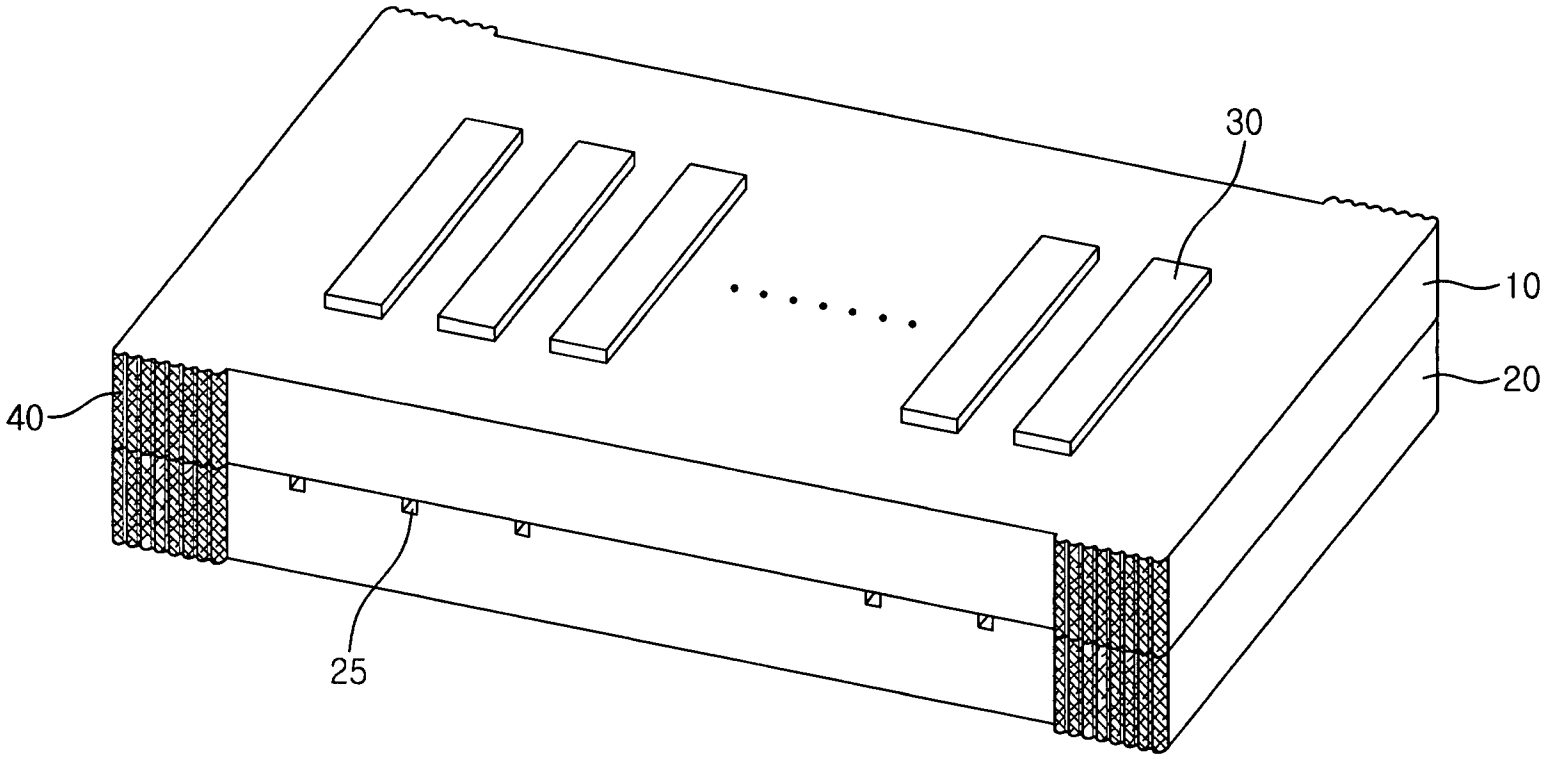
FIG. 10 is a perspective view illustrating an inkjet print head according to another exemplary embodiment of the present invention.

FIG. 10 is a perspective view illustrating an inkjet print head according to another exemplary embodiment of the invention. Referring to FIG. 10, the inkjet print head according to this embodiment includes the upper board 10 and the lower board 20 having the ink passages therein and the piezoelectric actuators 30 formed on the upper surface of the upper board 10.

The ink passages of the upper board 10 and the lower board 20 and the piezoelectric actuators 30 have substantially the same configuration as those of the inkjet print head according to the exemplary embodiment, shown in FIG. 1. For the convenience of explanation, a detailed description thereof will be omitted.

The inkjet print head according to this embodiment includes the cutting portions 40 formed outside the ink passages in cross section in the longitudinal direction and having cutting marks formed thereon. The cutting portions 40 include the cutting marks having surface roughness higher than that of other portions in cross section in the longitudinal direction. That is, the cutting marks are cut traces that may be generated when adjacent inkjet print heads on the wafer are mechanically cut away from each other by mechanical cutting.

When adjacent inkjet print heads on the wafer are cut away from each other, the creation of the smooth cutting surfaces therebetween is most preferred. However, cut traces may be created by mechanical cutting, and rough cutting surfaces may be created. In this embodiment, as the cutting marks protrude more than other portions in cross section in the longitudinal direction, rough cutting surfaces are formed. However, the present invention is not limited thereto. Various configurations are possible as long as the surface roughness of the cutting marks is higher than that of other portions in cross section in longitudinal direction.

In this embodiment, the cutting marks are formed at the nozzles, which correspond to one side of the inkjet print heads in the width direction. Alternatively, the cutting marks may also be formed on the other side of the inkjet print heads in the width direction.

Hereinafter, the inkjet print head according to this embodiment that has the above-described configuration will be described.

Figure 13:
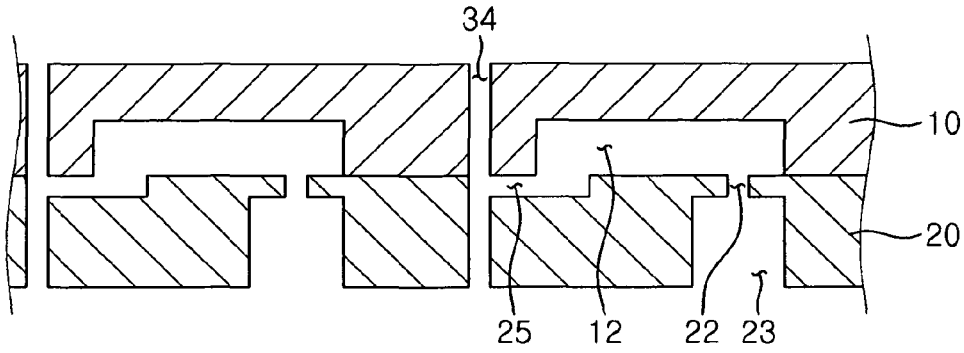
FIG. 13 is a cross-sectional view illustrating an operation of bonding the upper board and the lower board to each other in a method of manufacturing a wafer unit of the inkjet print head according to the exemplary embodiment as shown in FIG. 10.
Figure 14:
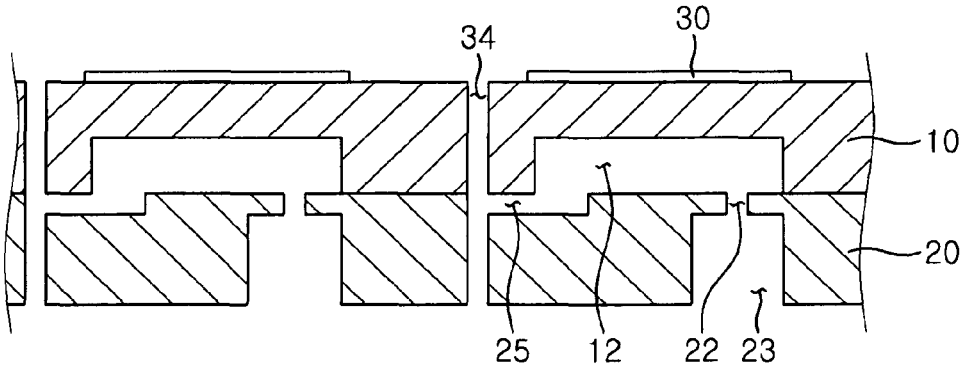
FIG. 14 is a cross-sectional view illustrating an operation of forming piezoelectric actuators on an upper part of the upper and lower boards bonded to each other in a method of manufacturing a wafer unit of the inkjet print head according to the exemplary embodiment as shown in FIG. 10.
Figure 15:
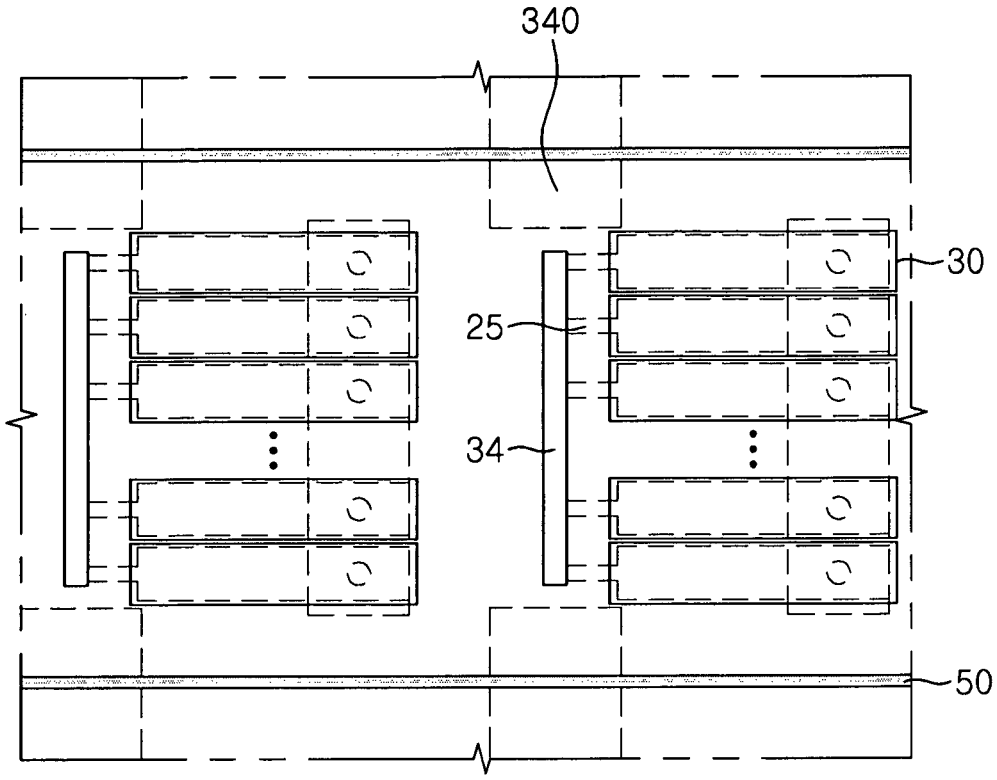
FIG. 15 is a plan view illustrating an operation of cutting side surfaces in a longitudinal direction in a method of manufacturing a wafer unit of the inkjet print head according to the exemplary embodiment as shown in FIG. 10.

FIGS. 11A through 11D are views illustrating an operation of forming ink passages in an upper board in a method of manufacturing a wafer unit of the inkjet print head according to the exemplary embodiment, as shown in FIG. 11. FIGS. 12A through 12E are views illustrating an operation of forming ink passages in a lower board. FIG. 13 is a cross-sectional view illustrating an operation of bonding the upper board and the lower board to each other. FIG. 14 is a cross-sectional view illustrating an operation of forming piezoelectric actuators on the upper board. FIG. 15 is a plan view illustrating an operation of cutting side surfaces in a longitudinal direction.

Since the operation of forming ink passages in the upper board and the lower board of the inkjet print head according to this embodiment and the operation of forming the piezoelectric actuators are substantially the same as those of the inkjet print head as shown in FIG. 1, a detailed description thereof will be omitted for the convenience of explanation.

Hereinafter, the differences in configurations will be mainly described.

Figure 11A:
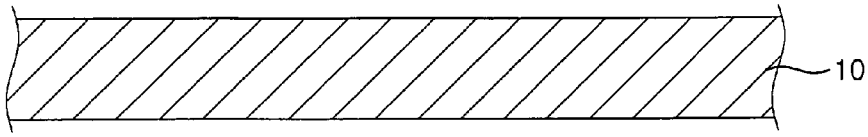
FIGS. 11A through 11D are views illustrating an operation of forming ink passages in an upper board in a method of manufacturing a wafer unit of the inkjet print head according to the exemplary embodiment as shown in FIG. 10.

First, as shown in FIG. 11A, the upper board 10, formed of a single crystal silicon board or an SOI wafer, is prepared.

Figure 11B:
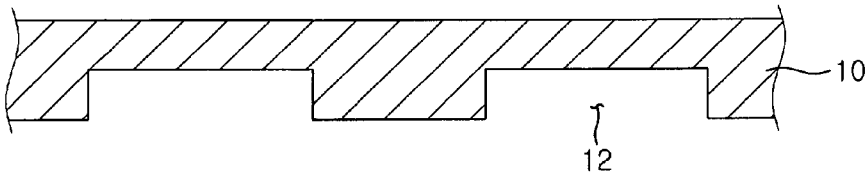

As shown in FIG. 11B, the lower surface of the upper board 10 is etched to thereby form the plurality of pressure chambers 12.

Figure 11C:
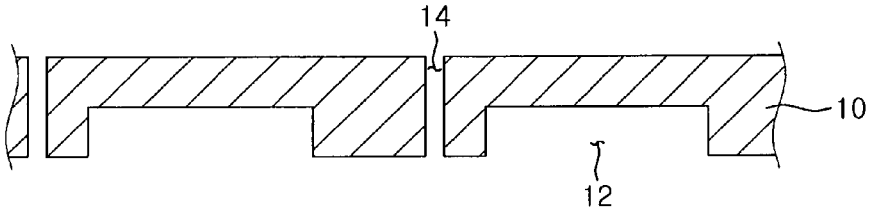
Figure 11D:
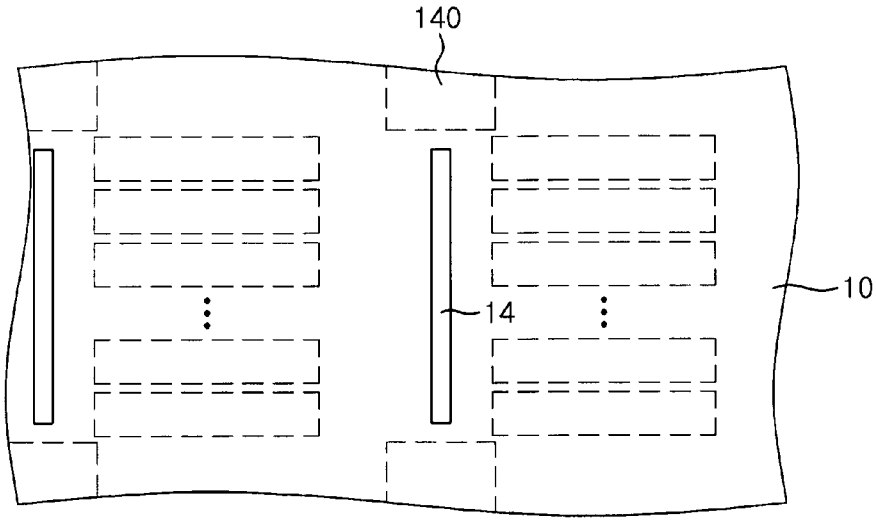

As shown in FIG. 11C, in order to form nozzles of adjacent inkjet print heads in the width direction, the upper board 10 is completely etched to thereby form the upper openings 14. As shown in FIG. 11D, the upper openings 14 are formed by etching the entire upper board 10 except for the upper connecting portions 140 in the longitudinal direction of the inkjet print heads.

Figure 12A:
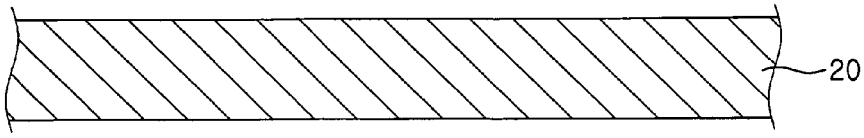
FIGS. 12A through 12E are views illustrating an operation of forming ink passages in a lower board in a method of manufacturing a wafer unit of the inkjet print head according to the exemplary embodiment as shown in FIG. 10.

Then, as shown in FIG. 12A, the lower board 20, formed of a single crystal silicon board or an SOI wafer, is prepared.

Figure 12B:
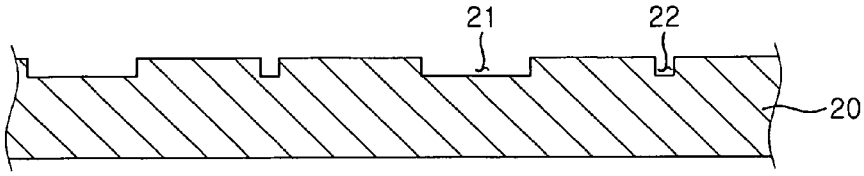

As shown in FIG. 12B, the upper surface of the lower board 20 is etched to thereby form the restrictors 22 and the passages 21 in which the dampers (not shown) and the nozzles 25 will be formed.

Figure 12C:
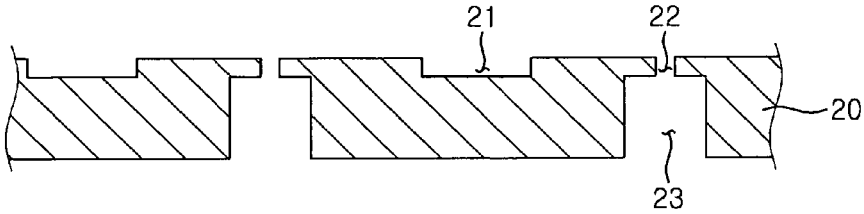

As shown in FIG. 12C, the lower surface of the lower board 20 is etched to thereby form the ink inlet (not shown) and the manifolds 23.

Figure 12D:
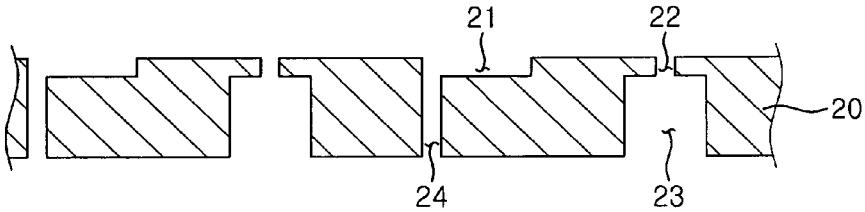
Figure 12E:
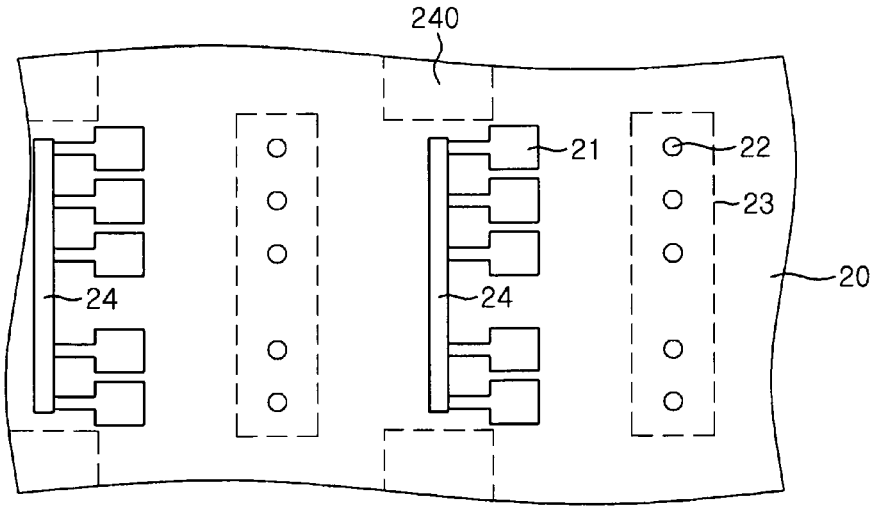

Then, as shown in FIG. 12D, in order to form nozzles in adjacent inkjet print heads in the width direction, the lower board 20 is completely etched to thereby form the lower openings 24. As shown in FIG. 12E, the lower openings 24 are formed by etching the entire lower board 20 except for the lower connecting portions 240 in the longitudinal direction of the inkjet print heads. Since the nozzles 25 are opened by etching, the shape of the nozzles 25 is not physically damaged. Furthermore, the ingress of foreign bodies, generated when the nozzles 25 are opened by mechanical processing, into the nozzles 25 can be prevented.

Then, as shown in FIG. 13, the upper board 10 and the lower board 20 are bonded to each other to thereby form a wafer having a plurality of inkjet print heads arrayed thereon. The upper board 10 and the lower board 20 may be bonded to each other by silicon direct bonding (SDB). That is, when the upper board 10 and the lower board 20 are sufficiently close to each other, the upper and lower boards 10 and 20 are directly bonded to each other by, for example, annealing without using an adhesive.

Subsequently, as shown in FIG. 14, the piezoelectric actuators 30 are formed on the upper surface of the upper board 10 at positions corresponding to the pressure chambers 12. The piezoelectric actuators 30 may be formed by using a method using a thick film process such as screen printing or a method of bonding bulk ceramic materials in head chip units.

Then, as shown in FIG. 15, in plurality of inkjet print heads arrayed in columns and rows on the wafer, side surface in the longitudinal direction of a plurality of inkjet print heads in a single row are cut to thereby separate the plurality of inkjet print heads from each other in rows. The side surfaces in the longitudinal direction of the inkjet print heads may be cut by dicing such as blade dicing, laser dicing or laser cutting.

Here, in order to reliably prevent the ingress of foreign bodies, generated by a dicing process through the nozzles 25 opened by etching, the upper and lower surfaces of the wafer may be coated with protective films, such as UV films or dicing films, before dicing, thereby achieving passivation.

When the side surfaces in the longitudinal direction of the inkjet print heads are exposed by dicing, in this embodiment, since the connecting portions 340 are formed on both sides in the longitudinal direction of the inkjet print heads, the ingress of foreign bodies, generated during dicing, into the nozzles 25 can be prevented.

Subsequently, the inkjet print head are separated into chip units by cutting the connecting portions 340, shown in FIG. 15, thereby completing the inkjet print head, as shown in FIG. 10. When passivation is performed before dicing, the separation into chip units needs to be carried out after the protective film is removed. The connecting portions 340 may be cut by mechanical processing, and cutting surfaces may be formed in the middle of the connecting portions 340.

Cutting marks having surface roughness higher than that of other portions in cross section in the longitudinal direction of the inkjet print heads may be formed on the cutting surfaces of the connecting portions 340.

Figure 16:
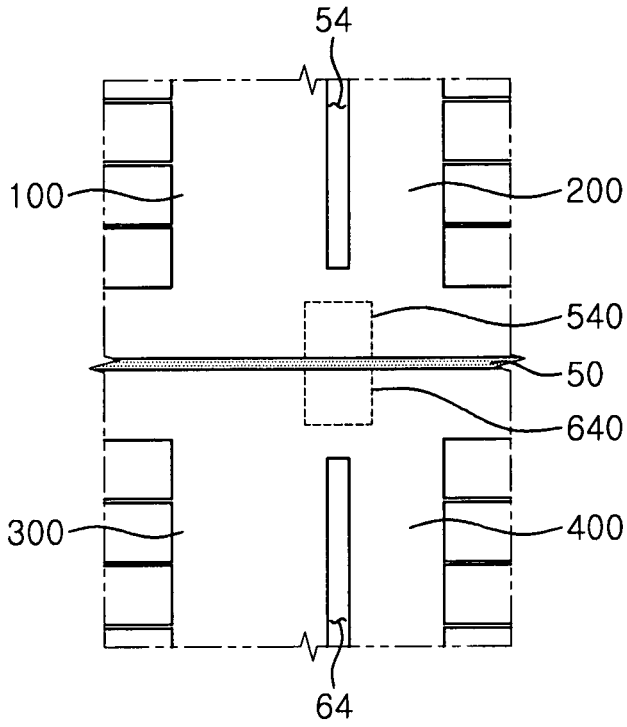
FIG. 16 is a partial plan view illustrating the configuration of connecting portions the inkjet print head according to the exemplary embodiment as shown in FIG. 10.

FIG. 16 is a partial plan view illustrating the configuration of connecting portions of the inkjet head according to the exemplary embodiment as shown in FIG. 10.

As shown in FIG. 16, the first connecting portion 540 is formed between the first and second inkjet print heads 100 and 200, and the second connecting portion 640 is formed between the third and fourth inkjet print heads 300 and 400.

The dicing line 50 is formed between the first connecting portion 540 and the second connecting portion 640. The first etching line 54 is formed between the first and second inkjet print heads 100 and 200, and the second etching line 64 is formed between the third and fourth inkjet print heads 300 and 40.

In this embodiment, auxiliary cutting portions are not formed in the first connecting portion 540 and the second connecting portion 640. Since the first connecting portion 540 and the second connecting portion 640 each have a thickness in unit of μm in the longitudinal direction of the inkjet print heads, any problem will not be caused when the first connecting portion 540 and the second connecting portion 640 are cut.

In terms of easy cutting and the evenness of cutting surfaces, the configuration of the connecting portions, as shown in FIG. 7, is expected to be better than that of the connecting portions as shown in FIG. 16. However, the connecting portions, as shown in FIG. 16, are manufactured by using operations simpler than those to form the connecting portions as shown in FIG. 7.

Figure 17:
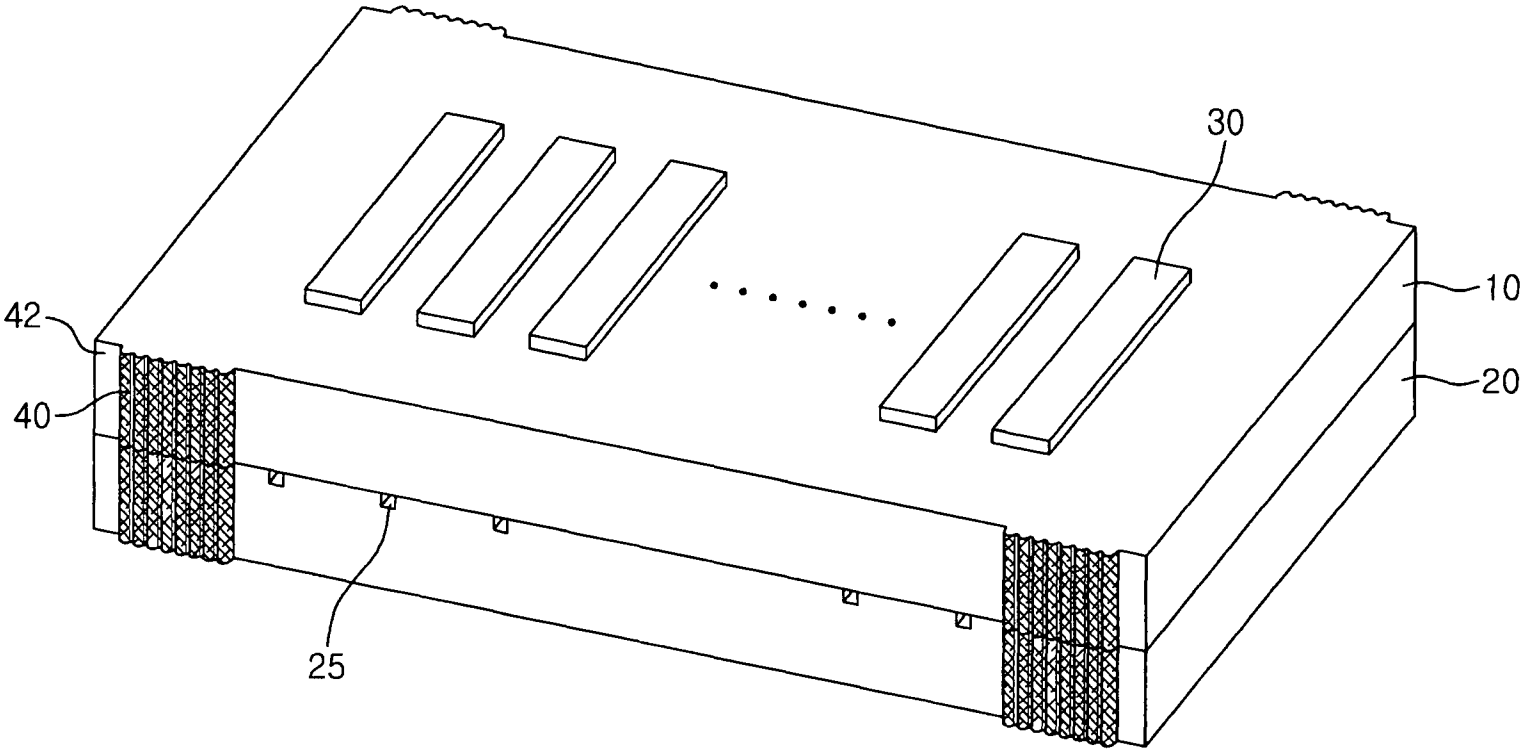
FIG. 17 is a view illustrating an inkjet print head according to another exemplary embodiment of the present invention.

FIG. 17 is a perspective view illustrating an inkjet print head according to another exemplary embodiment of the invention. The inkjet print head according to this embodiment, as shown in FIG. 17, has a configuration different from that of the inkjet print head according to the embodiment, as shown in FIG. 10, in that auxiliary cutting portions are formed within cutting surfaces of cutting portions. Hereinafter, for the convenience of explanation, the differences in configuration will be mainly described in more detail.

As shown in FIG. 17, the inkjet print head according to this embodiment may include the auxiliary cutting portions 42 within the cutting surfaces of the cutting portions 40 formed outside the ink passages in cross section in the longitudinal direction.

Here, cutting marks having surface roughness higher than that of other portions in cross section in the longitudinal direction are formed within the cutting surfaces of the cutting portions 40.

Furthermore, the auxiliary cutting portions 42 have relatively low surface roughness within the cutting marks.

When the upper and lower boards are completely etched in order to form nozzles of adjacent inkjet print heads in the width direction, the outside of the ink passages may be partially etched in cross section in the longitudinal direction in order to form the auxiliary cutting portions 42. Here, the upper and lower boards may be completely etched to thereby form the auxiliary cutting portions 42. Alternatively, the auxiliary cutting portions 42 may be formed by etching the upper and lower boards to thereby form recesses provided from one surface of the wafer inwardly in the thickness direction.

In this embodiment, the auxiliary cutting portions 42 are formed at a single place within the cutting marks. However, the present invention is not limited thereto. The auxiliary cutting portions 42 may be formed at various places within the cutting marks.

As such, when an inkjet print head according to an exemplary embodiment of the invention is configured, since nozzles of the inkjet print head are opened by etching, the shape of the nozzles is not physically damaged. Furthermore, as connecting portions are provided at both sides of the inkjet print head in the longitudinal direction, the ingress of foreign bodies, generated while the side surfaces in the longitudinal direction are cut by a dicing process, into the nozzles can be prevented.

COMPARATIVE EXAMPLE

An inkjet print head according to a comparative example is manufactured according to a side shooting type, which is the same as that of the present invention. However, as for the inkjet print head according to the comparative example, after an upper board and a lower board having ink passages therein are bonded to each other, nozzles are opened by a dicing process. Since the nozzles of the inkjet print head according to the comparative example are opened by the dicing process, the shape of the nozzles is physically damaged by dicing blades and is thus deformed.

Contrary to this, since nozzles of an inkjet print head according to an exemplary embodiment of the invention are opened by etching, the shape of the nozzles is not physically damaged. Furthermore, by providing connection portions at both sides of the inkjet print head in the longitudinal direction, the ingress of foreign bodies, generated when the side surfaces in the longitudinal direction are cut by a dicing process, into the nozzles can be prevented.

As set forth above, according to exemplary embodiments of the invention, the ingress of foreign bodies, generated when nozzles are opened and side surfaces in a width direction of an inkjet print head are cut, into the nozzles can be prevented.

Furthermore, as the nozzles are opened by etching, it is possible to prevent physical damage to the shape of the nozzles.

Therefore, ink ejection characteristics including the directionality of ink ejection of the inkjet print head or wettability can be improved.

Furthermore, by forming auxiliary cutting portions on an inkjet print head, it is easy to cut inkjet print heads into chip units and form smooth cutting surfaces.

While the present invention has been shown and described in connection with the exemplary embodiments, it will be apparent to those skilled in the art that modifications and variations can be made without departing from the spirit. For example, a method of forming ink passages of an inkjet print head according to an exemplary embodiment of the invention is merely exemplified. Various etching methods can be applied, and the order of performing respective operations in the manufacturing method may be changed. The scope of the invention as defined by the appended claims.

What is claimed is:

1. An inkjet print head comprising:

an inkjet board having an ink passage therein;

nozzles opened by etching;

cutting portions formed separately on both ends of the inkjet print head in a longitudinal direction of the inkjet print heads, and preventing the ingress of foreign bodies, generated during dicing, into the nozzles; and an auxiliary cutting portion provided from one surface of the cutting portion inwardly in a thickness direction of the inkjet board, and assisting the separation into head chip units of the inkjet board.

2. The inkjet print head of claim 1, wherein the cutting portion has a cutting mark which has surface roughness higher than another portion in cross section in the longitudinal direction.

3. The inkjet print head of claim 1, wherein the cutting portion has a cutting surface which comprises a portion provided outside the cutting mark and having surface roughness smaller than the cutting mark.

4. The inkjet print head of claim 1, wherein a portion having relatively small surface roughness is provided within the cutting mark.

5. The inkjet print head of claim 1, wherein openings of the nozzles opened by etching are at positions between the cutting portions.

6. The inkjet print head of claim 5, wherein the cutting portions on either end comprises a plurality of through holes formed through the inkjet print head.

7. An inkjet print head comprising:

an inkjet board having an ink passage therein;

nozzles opened by etching;

cutting portions formed separately on both ends of the inkjet print head in a longitudinal direction of the inkjet print heads, and preventing the ingress of foreign bodies, generated during dicing, into the nozzles; and an auxiliary cutting portion provided from one surface of one of the cutting portions inwardly in a thickness direction of the inkjet board, and assisting the separation into head chip units of the inkjet board.

8. The inkjet print head of claim 7, wherein the auxiliary cutting portion comprises at least one through hole formed through the inkjet board.

9. The inkjet print head of claim 7, wherein the auxiliary cutting portion comprises at least one recess provided from the one surface of the cutting portion inwardly in the thickness direction of the inkjet board.

10. The inkjet print head of claim 7, wherein openings of the nozzles opened by etching are at positions between the cutting portions.

11. A method of manufacturing an inkjet print head, the method comprising:

forming a plurality of ink passages in an upper board and a lower board in order to form a wafer having a plurality of inkjet print heads continuously arrayed thereon;

etching end portions of the plurality of ink passages in a longitudinal direction of the inkjet print heads in order to expose nozzles being the end portions of the ink passages while forming connection portions separately outside the ink passages;

etching the connecting portions partially in order to facilitate mechanically cutting of the connecting portions to thereby form recesses provided inwardly in a thickness direction of the inkjet print heads;

forming the wafer by bonding the upper board and the lower board to each other;

cutting the wafer in order to expose side surfaces in the longitudinal direction of the inkjet print heads; and mechanically cutting the connection portions.

12. The method of claim 11, further comprising partially etching the connecting portions in order to facilitate the mechanically cutting of the connecting portions to thereby form through holes formed through the inkjet print heads.

13. The method of claim 11, wherein the forming of the wafer is performed by silicon direct bonding (SDB) of the upper board and the lower board.

14. The method of claim 11, wherein above operations are performed in a sequential manner.

15. The method of claim 11, wherein the cutting of the wafer is performed by using a dicing process.

16. The method of claim 11, wherein the mechanically cutting of the connecting portions comprises forming cutting marks comprising cut traces on cutting surfaces of the connecting portions.

17. The method of claim 11, wherein the mechanically cutting of the connecting portions is performed so that surface roughness of cutting marks to be formed on cutting surfaces of the connecting portions is higher than that of another portion in cross section in the longitudinal direction of the inkjet print heads.

18. The method of claim 11, wherein an ink passage of the upper board is in communication with an ink passage of the lower board.

* * * * *